US007755288B2

(12) United States Patent
Kim

(10) Patent No.: US 7,755,288 B2
(45) Date of Patent: Jul. 13, 2010

(54) PLASMA DISPLAY PANEL AND MANUFACTURING METHOD THEREOF

(75) Inventor: Dong-hyun Kim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 197 days.

(21) Appl. No.: 12/018,695

(22) Filed: Jan. 23, 2008

(65) Prior Publication Data

US 2008/0191602 A1 Aug. 14, 2008

(30) Foreign Application Priority Data

Jan. 25, 2007 (KR) ..... 10-2007-0007974

(51) Int. Cl.
*H01J 17/49* (2006.01)
*H01J 9/24* (2006.01)

(52) U.S. Cl. ..... 313/587; 313/584; 313/585; 313/586; 445/24

(58) Field of Classification Search ..... 313/582–587; 445/24

See application file for complete search history.

(56) References Cited

U.S. PATENT DOCUMENTS

| | | | | |
|---|---|---|---|---|
| 2006/0082303 | A1* | 4/2006 | Song | 313/582 |
| 2006/0152158 | A1 | 7/2006 | Lee et al. | |
| 2006/0152159 | A1* | 7/2006 | Yoo | 313/587 |
| 2007/0216302 | A1 | 9/2007 | Hashimoto et al. | |
| 2007/0228493 | A1 | 10/2007 | Kim et al. | |

FOREIGN PATENT DOCUMENTS

| | | |
|---|---|---|
| EP | 1 796 124 A2 | 6/2007 |
| JP | 2002-212715 | 7/2002 |
| JP | 2006-120583 | 5/2006 |
| KR | 2002-0065753 | 8/2002 |
| KR | 10-2005-0021609 | 3/2005 |
| WO | WO 2005/098889 A1 | 10/2005 |

OTHER PUBLICATIONS

Patent Abstracts of Japan, Publication No. 2002-212715; Date of Publication: Jul. 31, 2002; in the name of Koichi Kodera et al.

Patent Abstracts of Japan, Publication No. 2006-120583; Date of Publication: May 11, 2006; in the name of Shinichi Yamamoto et al.

(Continued)

*Primary Examiner*—Bumsuk Won
(74) *Attorney, Agent, or Firm*—Christie, Parker & Hale, LLP

(57) ABSTRACT

A plasma display panel and a method for manufacturing the same. The plasma display panel includes: a first substrate; sustain electrodes on the first substrate, each being composed of an X electrode and a Y electrode; a first dielectric layer covering the sustain electrodes; a protective layer on the first dielectric layer; a second substrate facing the first substrate; address electrodes on the second substrate and crossing the sustain electrodes; a second dielectric layer covering the address electrodes; and barrier ribs for partitioning discharge spaces between the first substrate and the second substrate; and a phosphor layer at sides of the barrier ribs. Here, the protective layer is a single deposition layer having a non-uniform thickness, the sustain electrodes are located to correspond to a first region of the protective layer, and the first region of the protective layer is thicker than a second region of the protective layer.

17 Claims, 4 Drawing Sheets

OTHER PUBLICATIONS

Korean Patent Abstracts, Publication No. 1020020065753 A; Date of Publication: Aug. 14, 2002; in the name of Jun Hyeong Ahn.
Korean Patent Abstracts, Publication No. 1020050021609 A; Date of Publication: Mar. 7, 2005; in the name of Se Jong Kim et al.
Office Action dated Nov. 21, 2007 for corresponding Korean Patent Application No. 10-2007-0007974.
European Search Report dated Jul. 10, 2008, for corresponding European application 08100826.0, noting listed references in this IDS.

* cited by examiner

PLASMA DISPLAY PANEL AND MANUFACTURING METHOD THEREOF

CROSS-REFERENCE TO RELATED APPLICATION

This application claims priority to and the benefit of Korean Patent Application No. 10-2007-0007974, filed on Jan. 25, 2007, in the Korean Intellectual Property Office, the entire content of which is incorporated herein by reference.

BACKGROUND

1. Field of the Invention

The present invention relates to a plasma display panel.

2. Discussion of Related Art

Plasma display panels (PDPs) refer to flat display panels that display images using a gas discharge phenomenon. Such display panels may provide excellent display capabilities, e.g., large-capacity display, high brightness, high contrast, low image sticking, a wide-range of viewing angle, and so forth, and a thin/large screen, as compared to conventional cathode ray tube (CRT) displays.

With reference to FIG. 1, a conventional plasma display panel (PDP) 100 includes a first substrate 101, a second substrate 102, sustain electrodes 120, a first dielectric layer 105, a protective layer 106, address electrodes 107, a second dielectric layer 108, barrier ribs 109, and red, green, and blue phosphor layers 110. Each of the sustain electrodes 120 includes an X electrode 103 and a Y electrode 104 arranged in a pair, which are alternately arranged at a surface of the first substrate 101. The first dielectric layer 105 covers (or encases) the X electrode 103 and the Y electrode 104. The protective layer 106 is formed on a surface of the first dielectric layer 105. A corresponding one of the address electrodes 107 is arranged at a surface of the second substrate 102 to cross the X electrode 103 and the Y electrode 104. The second dielectric layer 108 covers (or encases) the address electrode 107. The barrier ribs 109 are installed between the first substrate 101 and the second substrate 102 and define a discharge space. The red, green, and blue phosphor layers 110 are coated on sides of the barrier ribs 109 and on a surface of the second dielectric layer 108.

The first substrate 101 and the second substrate 102 are formed to face each other with a gap therebetween. The gap formed between the first substrate 101 and the second substrate 102 is filled with a mixture of Ne+Xe gas or a mixture of He+Ne+Xe gas at a pressure level that may be predetermined (for example, 450 Torr).

In the PDP 100 having the construction as described above, when an electric signal is applied to the Y electrode 104 and the corresponding one of the address electrodes 107, a discharge cell is for an emission. When the electric signal is alternately applied to the X and Y electrodes 103 and 104, a visible ray is emitted from the phosphor layers 110 coated in the selected discharge (or emission) cell to display a static image and/or a moving image.

The X and Y electrodes 103 and 104 and the address electrodes 107 are driven by a circuit.

The protective layer 106 in the PDP 100 has three functions.

First, the protective layer 106 functions to protect an electrode and a dielectric material. That is, a discharge may be generated in an electrode only structure or in a dielectric material and electrode only structure. Here, when the discharge is generated in the electrode only structure, it may be difficult to control a discharge current. When the discharge is generated in the dielectric material and electrode only structure, because the dielectric material can be damaged due to a sputtering etch, the dielectric material should be coated with a protective layer, which is resistant to plasma ions.

Second, the protective layer 106 functions to reduce a discharge start voltage. A physical quantity directly related to the discharge start voltage is a secondary electron emission coefficient of a material that is used to form the protective layer 106 for plasma ion resistance. The more the secondary electron coefficient of the protective layer is, the less the discharge start voltage is. Accordingly, the greater the secondary electron emission coefficient of a material forming a protective layer is, the better a characteristic thereof is.

Finally, the protective layer 106 functions to reduce a discharge delay time. The discharge delay time is a physical quantity that refers to a time after which a discharge occurs from an applied voltage, and may be derived from a sum of a formation delay time and a statistical delay time. As the discharge delay time is reduced, the addressing speed is increased, thereby allowing for the use of a single scan, reducing a scan driver cost, and/or increasing the number of available sub fields. Also, the reduction of the discharge delay time can also provide the PDP 100 with improved luminance and/or image quality.

When the PDP 100 is driven, a voltage is applied into the panel and discharge gas injected therein is electrolyzed to form plasma.

However, when the plasma is generated, positive ions in the plasma periodically collide with the first substrate 101 by an alternating current voltage applied to the X and Y electrodes 103 and 104 of the first substrate 101.

The protective layer 106 may be etched (or damaged) by the ion shock, which is positioned at a peripheral part of the X and Y electrodes 103 and 104 of the first substrate 101.

When the protective layer 106 is etched, it interrupts a normal discharge in the panel, thereby reducing the lifespan of the PDP 100.

FIG. 2 is a picture showing an etching of a protective layer in a conventional plasma display panel. As shown in FIG. 2, an etch 130 of the protective layer 106 due to an ion shock mainly occurs at regions near an ITO electrode 103*b* and a bus electrode 104*a* of the X and Y electrodes 103 and 104.

SUMMARY OF THE INVENTION

An aspect of an embodiment of the present invention is directed to a plasma display panel that includes a protective layer for an electrode part on a substrate of the plasma display panel, the protective layer being thickly formed (e.g., without an additional and/or special process) to have a thickness capable of improving quality and/or lifespan of the plasma display panel.

An aspect of an embodiment of the present invention is directed to a plasma display panel and a method for manufacturing the same, which partially and/or thickly form a protective layer (e.g., without an additional and/or special process) to improve a lifespan of the plasma display panel.

In an embodiment of the present invention, a plasma display panel is provided. The plasma display panel includes: a first substrate; a plurality of sustain electrodes on the first substrate, each of the sustain electrodes being composed of an X electrode and a Y electrode; a first dielectric layer covering the sustain electrodes; a protective layer on the first dielectric layer; a second substrate facing the first substrate; a plurality of address electrodes on the second substrate and crossing the sustain electrodes; a second dielectric layer covering the address electrodes; and a plurality of barrier ribs for partitioning red, green, and blue discharge spaces between the first substrate and the second substrate; and a phosphor layer at a side of each of the barrier ribs, wherein the protective layer is a single deposition layer having a non-uniform thickness, wherein the sustain electrodes are located to correspond to a first region of the protective layer, and wherein a thickness portion of the first region of the protective layer is greater in thickness than a thickness portion of a second region of the protective layer.

In one embodiment, the second region of the protective layer is any region of the protective layer other than the first region of the protective layer.

In one embodiment, the thickness portion of the first region of the protective layer is set to be greater in thickness than the thickness portion of the second region of the protective layer by applying a negative bias voltage to the sustain electrodes. The protective layer may include a magnesium oxide (MgO). The protective layer may include a magnesium oxide that includes aluminum (Al) and/or calcium (Ca).

In one embodiment, the thickness portion of the first region of the protective layer is negative bias voltage thickened to be greater in thickness than the thickness portion of the second region of the protective layer.

In one embodiment, a thickness portion of the protective layer at a Y electrode part of the sustain electrodes is set to be greater in thickness than a thickness portion of the protective layer at an X electrode part of the sustain electrodes. The thickness portion of the first region of the protective layer may be set to be greater in thickness than the thickness portion of the second region of the protective layer by applying a negative bias voltage to the sustain electrodes, and the thickness portion of the protective layer at the Y electrode part of the sustain electrode may be set to be greater in thickness than the thickness portion of the protective layer at the X electrode part of the sustain electrode by applying a voltage to the Y electrodes of the sustain electrodes to be greater in intensity than that applied to the X electrodes of the sustain electrodes. Alternatively, the thickness portion of the first region of the protective layer may be set to be greater in thickness than the thickness portion of the second region of the protective layer by applying a negative bias voltage to the sustain electrodes, and the thickness portion of the protective layer at the Y electrode part of the sustain electrode may be set to be greater in thickness than the thickness portion of the protective layer at the X electrode part of the sustain electrode by applying a voltage to the Y electrodes of the sustain electrodes to be greater in time period than that applied to the X electrodes of the sustain electrodes.

According to another embodiment of the present invention, a method for manufacturing a plasma display panel is provided. The method includes: forming a sustain electrode on a first substrate; forming a first dielectric layer to cover the sustain electrode; and forming a protective layer of a non-uniform thickness on the first dielectric layer by a single deposition so that a first region of the protective layer is located to correspond to the sustain electrode and a thickness portion of the first region of the protective layer is formed to be greater in thickness than a thickness portion of a second region of the protective layer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
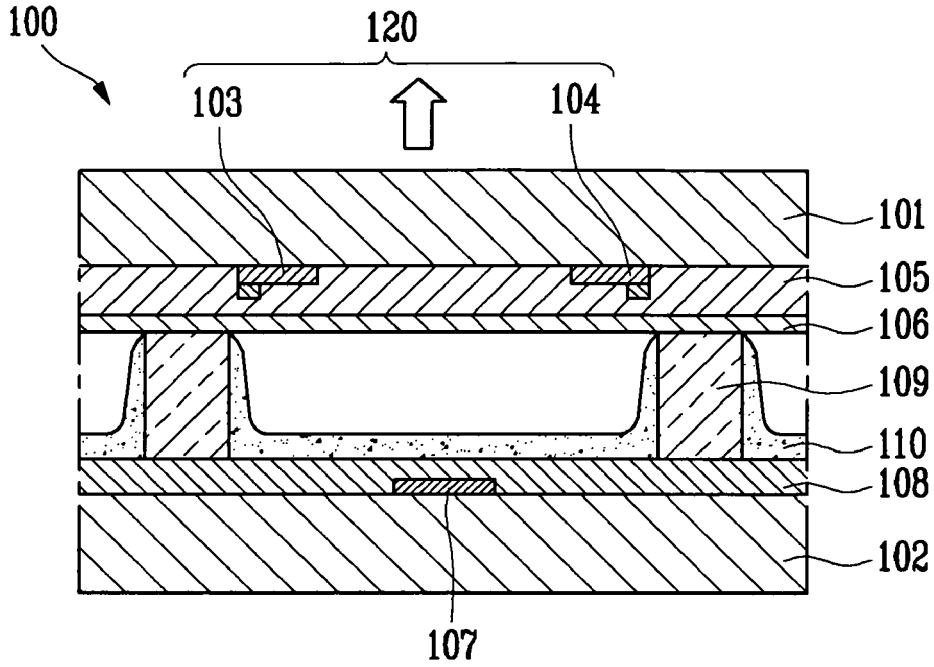
FIG. 1 (RELATED ART)
FIG. 1 is a cross-sectional view showing an unit cell structure of a conventional plasma display panel (PDP)
Figure 2:
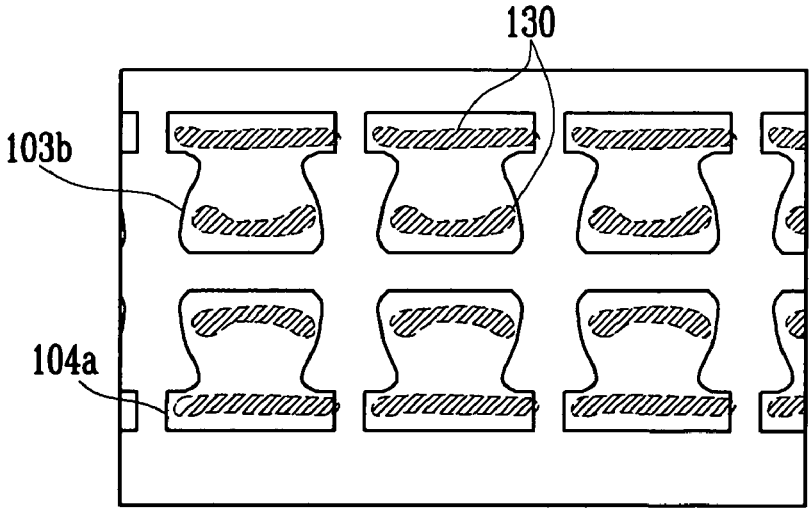
FIG. 2 (RELATED ART)
FIG. 2 is a picture showing an etching of a protective layer in the conventional plasma display panel.

Hereinafter, exemplary embodiments according to the present invention will be described with reference to the accompanying drawings. Here, when one element is described as being connected to another element, one element may be not only directly connected to another element but instead may be indirectly connected to another element via one or more other elements. Also, in the context of the present application, when an element is referred to as being "on" another element, it can be directly on the another element or be indirectly on the another element with one or more intervening elements interposed therebetween. Further, some of the elements that are not essential to the complete description of the invention have been omitted for clarity. Also, like reference numerals refer to like elements throughout.

Figure 3:
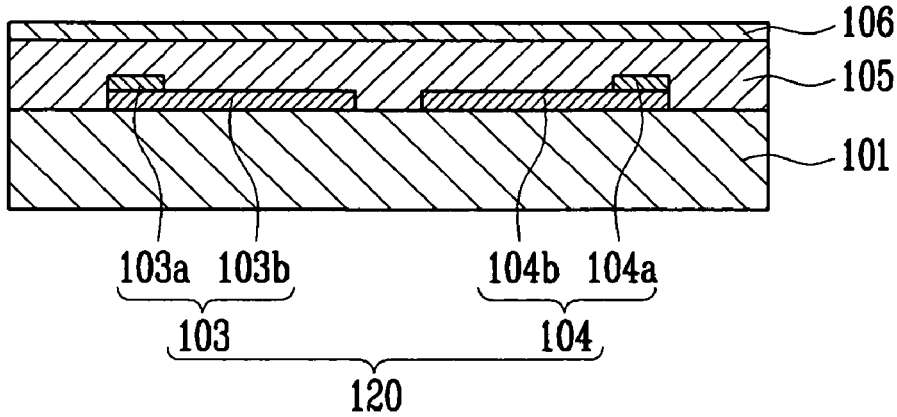
FIG. 3 (RELATED ART)
FIG. 3 is a cross-sectional view showing an upper substrate structure of a conventional PDP.

Referring to FIG. 3, in the PDP 100 of FIG. 1, the protective layer 106 is uniformly deposited on the first substrate 101 to have a uniform thickness.

FIG. 3 is a cross-sectional view showing an upper substrate structure of the PDP 100. The X electrode 103 and the Y electrode 104 are disposed on a second surface (upper surface in FIG. 3) of the first substrate 101. The dielectric layer 105 covers the X electrode 103 and the Y electrode 104. The protective layer 106 is formed on the dielectric layer 105 with an uniform thickness. The X electrode 103 and the Y electrode 104 include ITO electrodes 103*b* and 104*b* and bus electrodes 103*a* and 104*a*, respectively.

As such, in the conventional plasma display panel in which the protective layer 106 is formed with the uniform thickness, the protective layer 106 is etched by an ion shock when the panel is driven, thereby reducing a lifespan of the panel. Thus, there is a need to increase (or partially increase) a thickness of the protective layer 106.

Figure 4:
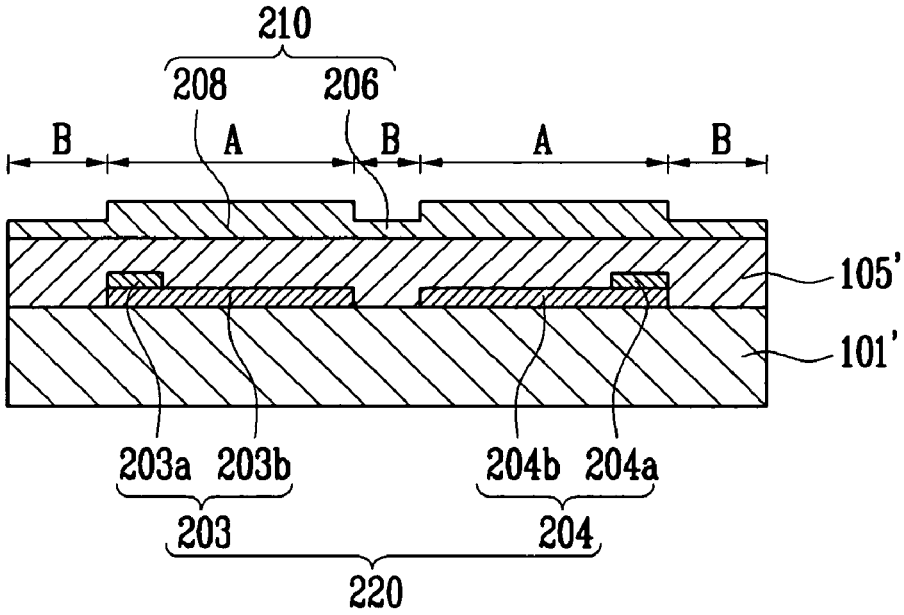
FIG. 4 is a cross-sectional view showing an upper substrate structure of a plasma display panel (PDP) according to an embodiment of the present invention.

FIG. 4 is a cross-sectional view showing a substrate (or an upper substrate) structure of a plasma display panel (PDP) according to an embodiment of the present invention.

As shown, in the upper substrate structure of the PDP, a sustain electrode 220 is provided at a second surface (upper surface in FIG. 4) of a substrate (or a first substrate) 101'. The sustain electrode 220 is composed of an X electrode 203 and a Y electrode 204. A dielectric layer 105' covers (or encases) the sustain electrode 220. A protective layer 210 is formed on the dielectric layer 105'. The X electrode 203 and the Y electrode 204 include ITO electrodes 203*b* and 204*b* and bus electrodes 203*a* and 204*a*, respectively.

Here, the protective layer 210 is a single deposition layer. However, the protective layer 210 is not deposited with the same thickness. A thickness of the protective layer 210 is partially and non-uniformly formed. In more detail, in the protective layer 210, a first thickness portion 208 of the protective layer 210 at a region A formed on the sustain electrode 220 is formed to be greater than that of a second thickness portion 206 of the protective layer 210 at a region B corresponding to regions of the protective layer 210 other than regions of the protective layer 210 corresponding to the sustain electrode 220.

As described earlier, so as to form a thickness of the first thickness portion 208 of the protective layer 210 at the region A to be greater than that of a thickness of the second thickness portion 206 of the protective layer 210 at the region B, in an embodiment of the present invention, a negative bias voltage is applied to the sustain electrode 220 as a bias during a formation of the protective layer 210.

When the negative bias voltage is applied to the sustain electrode 220 of the upper substrate structure during a deposition, more positive ions separated from an oxide are accumulated at the sustain electrode 220 region (or side) to which a negative bias voltage is applied during a deposition of the protective layer 210, thereby relatively increasing the thickness of the first thickness portion 208 of the protective layer 210.

Accordingly, the thickness of the first thickness portion 208 of the protective layer 210 can be increased on the desired ITO electrodes 203*b* and 204*b* and bus electrodes 203*a* and 204*a*.

In one embodiment, the protective layer 210 is formed by magnesium oxide (MgO) in the form of an oxide film. Further, the protective layer 210 can be formed by magnesium oxide that includes a material selected from the group consisting of aluminum Al calcium Ca, and combinations thereof.

In addition, a formation method of the protective layer 210 can be formed by various suitable protective layer formation methods. For example, the protective layer 210 can be formed by a sputtering method and/or an ion plating method. However, the present invention is not limited thereto.

As described above, the thickness of the first thickness portion 208 of the protective layer 210 at the region A on which the sustain electrode 220 is formed is set to be greater than that of the second thickness portion 206 of the protective layer 210 at the region B other than the region A. Accordingly, although the first thickness portion 208 of the protective layer 210 present at a peripheral part of the X and Y electrodes 203 and 204, being a sustain electrode of the first substrate 101, may experience an ion shock due to positive plasma ions when the panel is driven, since the thickness of the protective layer 210 is not thinly formed at the first thickness portion 208, this thickness portion 208 can more easily withstand the ion shock than the protective layer 206 formed at a region (region B) other than the sustain electrode, thereby increasing a lifespan of the plasma display panel due to etching of the protective layer 210.

Figure 5A:
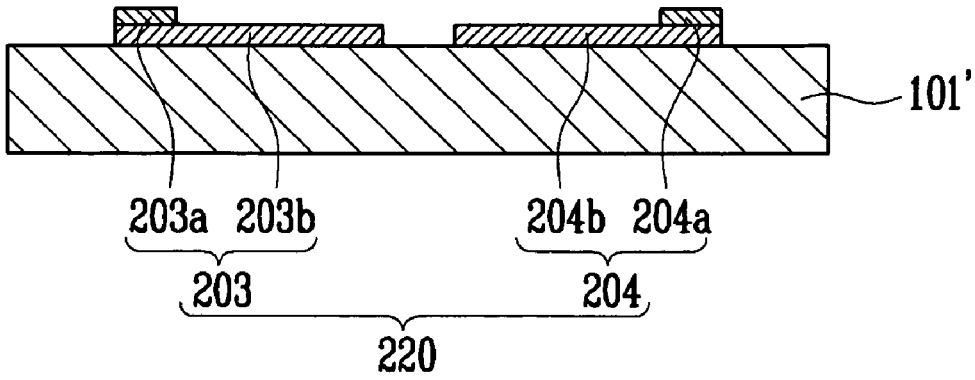
FIGS. 5A, 5B, and 5C are cross-sectional views of an upper substrate structure of a PDP for illustrating a method for manufacturing the upper substrate structure of the PDP according to an embodiment of the present invention.
Figure 5B:
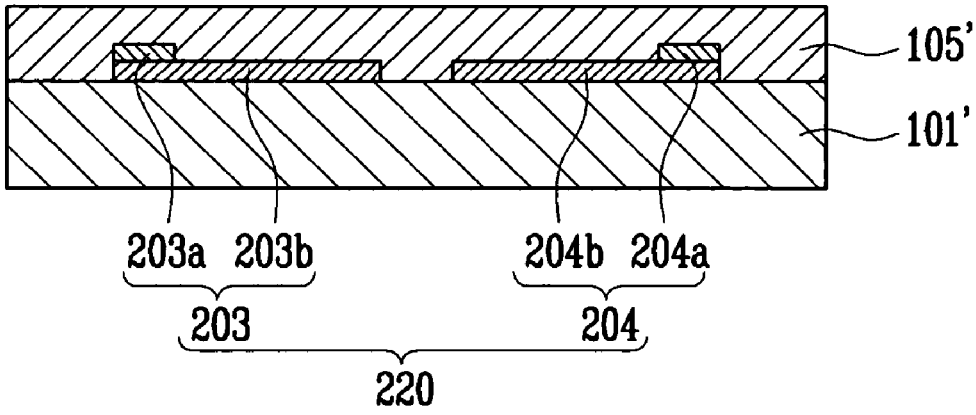
Figure 5C:
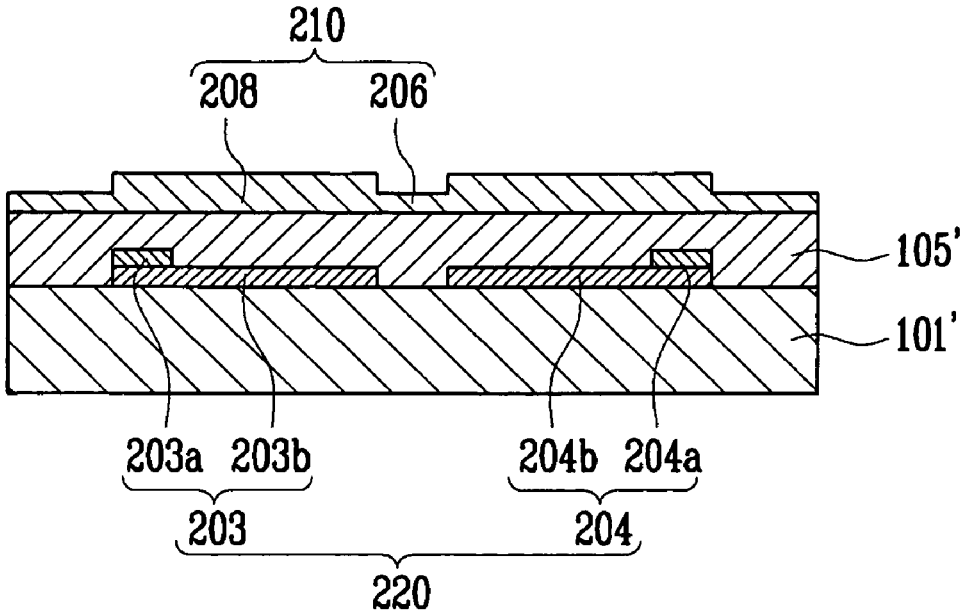

FIGS. 5A, 5B, and 5C are cross-sectional views of an upper substrate structure of a PDP for illustrating a method for manufacturing the upper substrate structure of the PDP according to an embodiment of the present invention.

The method for manufacturing the upper substrate structure of the plasma display panel of the present invention includes the steps of: forming the sustain electrode 220 on the first substrate 101' (FIG. 5A); forming the first dielectric layer 105' to cover the sustain electrode 220 (FIG. 5C); and forming the protective layer 210 with an non-uniform thickness on the first dielectric layer 105' by a single deposition (FIG. 5C).

The formation step of the protective layer 210 forms the first thickness region 208 of the protective layer 210 on the sustain electrode 220 to be greater than that of the second thickness region 206 of the protective layer 210 at a part other than a part corresponding to the sustain electrode 220 by applying a negative bias voltage to the sustain electrode 220.

The formation method of the protective layer 210 is not limited to the above described method and can be formed by various suitable formation methods. A sputtering method and an ion plating method are examples of the formation methods of the protective layer 210. However, the present invention is not limited thereto.

In one embodiment, for example, when the protective layer 210 is deposited with magnesium oxide MgO, the magnesium oxide is divided into magnesium positive ion $Mg^{2+}$ and oxide negative ion $O_2^-$. In an upper substrate of a plasma display panel on which a magnesium deposition material is formed, more magnesium positive ion $Mg^{2+}$ is accumulated in a sustain electrode 220 part to which a negative bias voltage is applied in comparison with a part to which a voltage is not applied so that a thickness of MgO film is relatively thicker.

Accordingly, the first thickness portion 208 of the protective layer 210 on the sustain electrode 220 is formed to be thicker than the second thickness portion 206 of the protective layer 210 on the part other than the part corresponding to the sustain electrode 220.

In the method for manufacturing the plasma display panel of the present invention, a thickness of a protective layer is differently formed according to its position during a formation thereof in order to enhance a lifespan of the plasma display panel.

Figure 6:
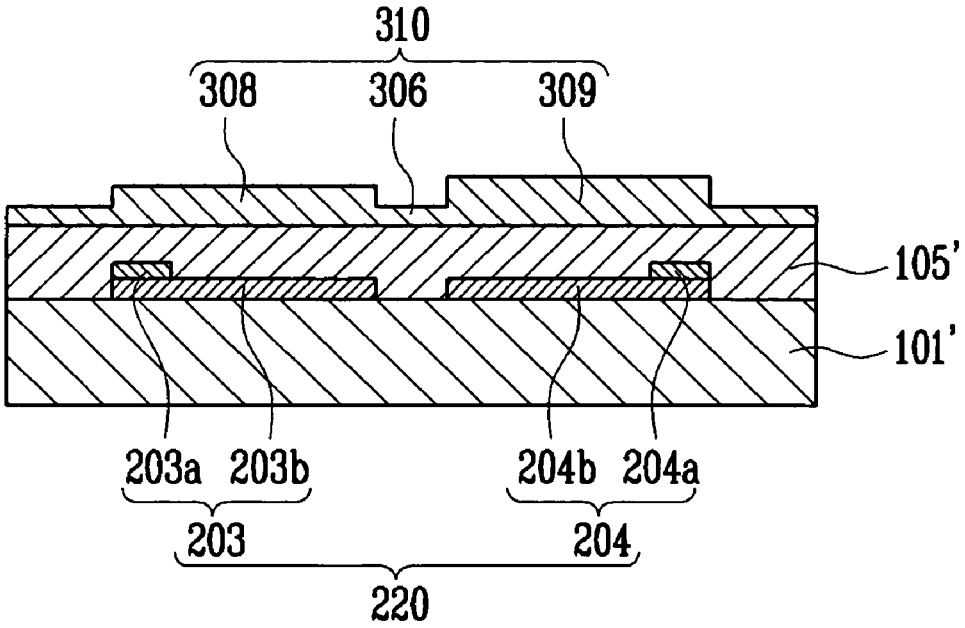
FIG. 6 is a cross-sectional view showing a cross-sectional view of an upper substrate structure of a PDP according to another embodiment of the present invention.

FIG. 6 is a cross-sectional view showing a cross-sectional view of an upper substrate structure of a PDP according to another embodiment of the present invention. When the plasma display panel is driven, an electric signal is applied to an address electrode and a Y electrode 204 to select a discharge cell for an emission. Further, since the electric signal is alternately applied to the X and Y electrodes 203 and 204, the Y electrode is etched deeper than the X electrode.

In consideration of this, the embodiment of FIG. 6 of the present invention forms a first thickness region 309 of the protective layer 310 at a region corresponding to a Y electrode 204 part of the sustain electrode 220 that is thicker than that of a second thickness region 308 of protective layer 310 at a region corresponding to an X electrode 203 part of the sustain electrode 220. In addition, the second thickness region 308 of the protective layer 310 at the region corresponding to the X electrode 203 part of the sustain electrode 220 is thicker than that of a thick thickness region 306 of protective layer 310 at a region not corresponding to the X electrode 203 part of the sustain electrode 220 and the Y electrode part 204 part of the sustain electrode 220.

In one embodiment for forming the protective layer 310, an intensity of a voltage applied to the Y electrode 204 of the sustain electrode 220 is adjusted to be greater than that applied to the X electrode 203 thereof. Alternatively, in another embodiment, a time period of a voltage applied to the Y electrode 204 of the sustain electrode 220 is adjusted to be greater than that applied to the X electrode 203 thereof.

In a method for manufacturing a plasma display panel according to an embodiment of the present invention, a first thickness portion (e.g., 309) of a protective layer (e.g., 310) of a Y electrode part is formed to be greater than that of a second thickness portion (e.g., 308) of the protective layer of an X electrode part so that a lifespan of the plasma display panel can be enhanced.

In view of the foregoing, in a plasma display panel according to an embodiment of the present invention, a thickness of a protective layer of an electrode part on a first substrate is thickly formed (e.g., is thickly formed without an additional and/or special process) to improve the quality and lifespan of a product.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display panel comprising:

a first substrate;

a plurality of sustain electrodes on the first substrate, each of the sustain electrodes being composed of an X electrode and a Y electrode;

a first dielectric layer covering the sustain electrodes;

a protective layer on the first dielectric layer;

a second substrate facing the first substrate;

a plurality of address electrodes on the second substrate and crossing the sustain electrodes;

a second dielectric layer covering the address electrodes; and a plurality of barrier ribs between the first substrate and the second substrate to define a plurality of discharge cells; and a phosphor layer at the discharge cells, wherein the sustain electrodes are located to correspond to a first region of the protective layer, wherein the first region of the protective layer is greater in thickness than a second region of the protective layer, and wherein the first region of the protective layer is formed of an identical material as that of the second region of the protective layer.

2. The plasma display panel as claimed in claim 1, wherein the protective layer is a single deposition layer having a non-uniform thickness.

3. The plasma display panel as claimed in claim 1, wherein the second region of the protective layer is any region of the protective layer other than the first region of the protective layer.

4. The plasma display panel as claimed in claim 1, wherein the first region of the protective layer is set to be greater in thickness than the second region of the protective layer by applying a negative bias voltage to the sustain electrodes.

5. The plasma display panel as claimed in claim 1, wherein the protective layer comprises a magnesium oxide (MgO).

6. The plasma display panel as claimed in claim 1, wherein the protective layer comprises a magnesium oxide including aluminum (Al) and/or calcium (Ca).

7. The plasma display panel as claimed in claim 1, wherein the first region of the protective layer is negative bias voltage thickened to be greater in thickness than the the second region of the protective layer.

8. A plasma display panel comprising:

a first substrate;

a plurality of sustain electrodes on the first substrate, each of the sustain electrodes being composed of an X electrode and a Y electrode;

a first dielectric layer covering the sustain electrodes;

a protective layer on the first dielectric layer;

a second substrate facing the first substrate;

a plurality of address electrodes on the second substrate and crossing the sustain electrodes;

a second dielectric layer covering the address electrodes; and a plurality of barrier ribs between the first substrate and the second substrate to define a plurality of discharge cells; and a phosphor layer at the discharge cells, wherein a thickness portion of the protective layer at a Y electrode part of the sustain electrodes is set to be greater in thickness than a thickness portion of the protective layer at an X electrode part of the sustain electrodes.

9. The plasma display panel as claimed in claim 8, wherein the thickness portion of the protective layer at the Y electrode part of the sustain electrode is set to be greater in thickness than the thickness portion of the protective layer at the X electrode part of the sustain electrode by applying a voltage to the Y electrodes of the sustain electrodes to be greater in intensity than that applied to the X electrodes of the sustain electrodes.

10. The plasma display panel as claimed in claim 8, wherein the thickness portion of the protective layer at the Y electrode part of the sustain electrode is set to be greater in thickness than the thickness portion of the protective layer at the X electrode part of the sustain electrode by applying a voltage to the Y electrode of the sustain electrodes to be greater in time period than that applied to the X electrode of the sustain electrodes.

11. A method for manufacturing a plasma display panel, the method comprising:

forming a sustain electrode on a first substrate;

forming a first dielectric layer to cover the sustain electrode; and forming a protective layer of a non-uniform thickness and of an identical material on the first dielectric layer by a single deposition so that a first region of the protective layer is located to correspond to the sustain electrode and the first region of the protective layer is formed to be greater in thickness than a second region of the protective layer.

12. The method as claimed in claim 11, wherein the forming the protective layer comprises:

applying a negative bias voltage to the sustain electrodes; and forming the first region of the protective layer to be greater in thickness than the second region of the protective layer by the applying of the negative bias voltage to the sustain electrodes.

13. The plasma display panel as claimed in claim 12, wherein the forming the protective layer comprises:

applying a voltage to a Y electrode of the sustain electrode to be greater in intensity than that applied to an X electrode of the sustain electrode.

14. The plasma display panel as claimed in claim 13, wherein the forming the protective layer comprises:

forming a thickness portion of the protective layer at a Y electrode part of the sustain electrode to be greater in thickness than a thickness portion of the protective layer at an X electrode part of the sustain electrode.

15. The plasma display panel as claimed in claim 12, wherein the forming the protective layer comprises:

applying a voltage to a Y electrode of the sustain electrode to be greater in time period than that applied to an X electrode of the sustain electrode.

16. The plasma display panel as claimed in claim 15, wherein the forming the protective layer comprises:

forming a thickness portion of the protective layer at a Y electrode part of the sustain electrode to be greater in thickness than a thickness portion of the protective layer at an X electrode part of the sustain electrode.

17. A plasma display panel comprising:

a first substrate;

a sustain electrode on the first substrate and comprising a first electrode and a second electrode;

a first dielectric layer covering the sustain electrode;

a protective layer on the dielectric layer;

a second substrate facing the first substrate;

an address electrode on the second substrate and crossing the sustain electrode;

a second dielectric layer covering the address electrode; and a plurality of barrier ribs between the first substrate and the second substrate to define a plurality of discharge cells; and a phosphor layer at a side of each of the barrier ribs, wherein the protective layer is a single deposition layer having a non-uniform thickness, wherein the sustain electrode is located to correspond to a first region of the protective layer, wherein the first region of the protective layer is thicker than a second region of the protective layer, wherein the first region of the protective layer is formed of an identical material as that of the second region of the protective layer, and wherein the second region of the protective layer is any region of the protective layer other than the first region of the protective layer.

* * * * *

UNITED STATES PATENT AND TRADEMARK OFFICE

CERTIFICATE OF CORRECTION

PATENT NO. : 7,755,288 B2
APPLICATION NO. : 12/018695
DATED : July 13, 2010
INVENTOR(S) : Dong-hyun Kim It is certified that error appears in the above-identified patent and that said Letters Patent is hereby corrected as shown below:

In the Claims

Column 7, Claim 7, line 54 After "than" Delete "the"

Signed and Sealed this
Fifteenth Day of November, 2011

David J. Kappos

David J. Kappos
*Director of the United States Patent and Trademark Office*